United States Patent [19]

Yang

[11] Patent Number: 4,836,507

[45] Date of Patent: Jun. 6, 1989

[54] ARAMID STAPLE AND PULP PREPARED BY SPINNING

[75] Inventor: Hung H. Yang, Richmond, Va.

[73] Assignee: E. I. Du Pont de Nemours and Company, Wilmington, Del.

[21] Appl. No.: 83,186

[22] Filed: Aug. 10, 1987

[51] Int. Cl.[4] ..... D01D 5/14

[52] U.S. Cl. ..... 264/143; 264/561; 264/162; 264/181; 264/184; 264/210.3; 264/210.8; 264/211.14

[58] Field of Search ..... 264/5, 14, 561, 142, 264/141, 143, 148, 180, 184, 210.3, 210.8, 211.14, 162

[56] References Cited

U.S. PATENT DOCUMENTS 3,767,756 10/1973 Blades ..... 264/184
3,869,429 3/1975 Blades ..... 260/78
4,298,565 11/1981 Yang ..... 264/181
4,340,559 7/1982 Yang ..... 264/181

OTHER PUBLICATIONS

Research Disclosure, Aug. 1975, No. 13675, "Synthetic Paper Pulp".

*Primary Examiner*—Hubert Lorin

[57] ABSTRACT

Directly spinning highly oriented staple fibers of para-aramids using a dry-jet wet-spinning process in which the filaments in the gap between the spinneret and the coagulating fluid are attenuated with a liquid jetted symmetrically about the filaments at a rate sufficient to break the filaments intermittently to form staple length fibers that taper along their length from an enlarged head.

3 Claims, 1 Drawing Sheet

ARAMID STAPLE AND PULP PREPARED BY SPINNING

This invention relates to a type of aramid staple and to a process for its direct preparation during spinning.

It is well-known that filaments characterized by high molecular orientation, high crystallinity, high tenacity, and high tensile modulus can be obtained directly on extruding and coagulating an optically anisotropic spinning dope of para-aramids. Generally, multifilament yarns are so prepared. Such fibers are as described in Blades U.S. Pat. No. 3,869,429. The fibers may be prepared using the spinning process described in Blades U.S. Pat. No. 3,767,756 which involves spinning the filaments by extruding an optically anisotropic acid solution of aromatic polyamide through at least one spinning capillary, then forwarding the filaments first through a layer of inert non-coagulating fluid and then into a coagulating bath. This process is also known as the "dry-jet wet spinning process." The term "para-aramid", as used herein, includes the homopolymers and copolymers described by Blades in U.S. Pat. No. 3,869,429 which, for the most part, are all-aromatic polyamides the aromatic units of which have chain-extending bonds which are either para-oriented or opposite and parallel. The most preferred of the para-aramids is poly(p-phenylene terephthalamide) (PPD-T), fibers of which are commercially available from E. I. du Pont de Nemours under the trademark "Kevlar".

An anisotropic para-aramid fiber as above described is structurally composed of a bundle of linear, axially aligned microfibers which provide very high strength along the fiber axis but are relatively easily separated transversely to the axis. As a consequence, para-aramid fibers tend to fibrillate when cut or abraded, which is generally regarded as negative.

Fibrillation has, however, been found advantageous in that, by wet or dry refining, fibers may be converted to "pulp", i.e., a fibrous form having very short fiber-lengths along which there are still-attached fibrils. Fiber length and degree of fibrillation are dependent both on intensity of the refining process and the time it is applied. Thus, as refining continues, the average length becomes shorter. In the extreme, the original fiber also splits to provide fibrillated fibrous elements of reduced diameter. Pulp of PPD-T is commercially available having fibrous stem elements about 12 μm or less in diameter and lengths averaging either 2 or 4 mm. Essentially all of these fibrous elements have multiple fibrils extending from and attached to their surfaces. For the reinforcement of elastomers or resins (both thermoplastic and thermosetting) pulp has proven to be excellent. Because of its small size, it is relatively easily dispersed uniformly in a matrix polymer, but its high L/D (length to diameter) still results in superior reinforcement. These pulps are now used extensively, for example, in brake shoes and pads, in clutch facings, in reinforced rubber products like tire treads, V-belts, etc., and in gaskets.

For a more complete description of pulp and pulping, reference is made to Research Disclosure No. 13675 (August 1975) and Research Disclosure No. 19037 (February 1980).

"Refining", as meant herein, is a process of abrading fibrous material to convert it into pulp, and such has long been practiced for wood pulp, for example. Analagously to wood pulp, commercially feasible refining of para-aramids is facilitated by first reducing filaments to shorter lengths, i.e., to staple. Uniformity of staple length is relatively unimportant, but it is generally preferable that no cut length exceed about 5 inches (12.7 cm). Otherwise, the staple tends to entangle and form agglomerations which disrupt pulping.

Para-aramid filaments are known to be difficult to cut and cause rapid dulling of cutting blades. Thus, generation of their staple fibers is time-consuming and expensive. The provision of staple without the use of cutting is, therefore, a very desirable objective.

SUMMARY OF THE INVENTION

This invention provides directly on spinning highly oriented staple fibers of para-aramids by using the dry-jet wet spinning process as described in the aforesaid U.S. Pat. No. 3,767,756 modified to the extent of attenuating the filaments in the gap between the spinneret and the coagulating fluid at a rate so high that the filaments repetitively break. Each staple fiber is continuously tapered along its length from an enlarged end of slightly less molecular orientation to a sharply pointed end of very high molecular orientation.

In order to attenuate the extruded filaments, it is necessary to use a technique other than downstream forwarding rolls. Otherwise, breaking of threadlines by attenuation would terminate the forwarding. A preferred method for providing the necessary attenuation is the process claimed in U.S. Pat. No. 4,298,565, which is incorporated herein by reference, wherein additional coagulating liquid is jetted at an angle of about 30° to the direction of the threadline path of travel symmetrically onto the filaments within 2.0 milliseconds of their entry into the spin tube. The only modification required of this process is an increase in axial velocity of the jetted coagulating liquid to an extent it accelerates and attenuates the extended filaments sufficiently to cause them to break into staple fibers that taper from one end to the other. Preferably, the ratio of the velocity of the vertically downward component, i.e., axial velocity, of the jetted coagulating liquid to the extrusion velocity of the filaments is at least 9. Further preferred is the process of U.S. Pat. No. 4,340,559, also incorporated herein by reference using a shallow bath of coagulating liquid.

DETAILED DESCRIPTION OF THE ILLUSTRATED EMBODIMENT

Figure 1:
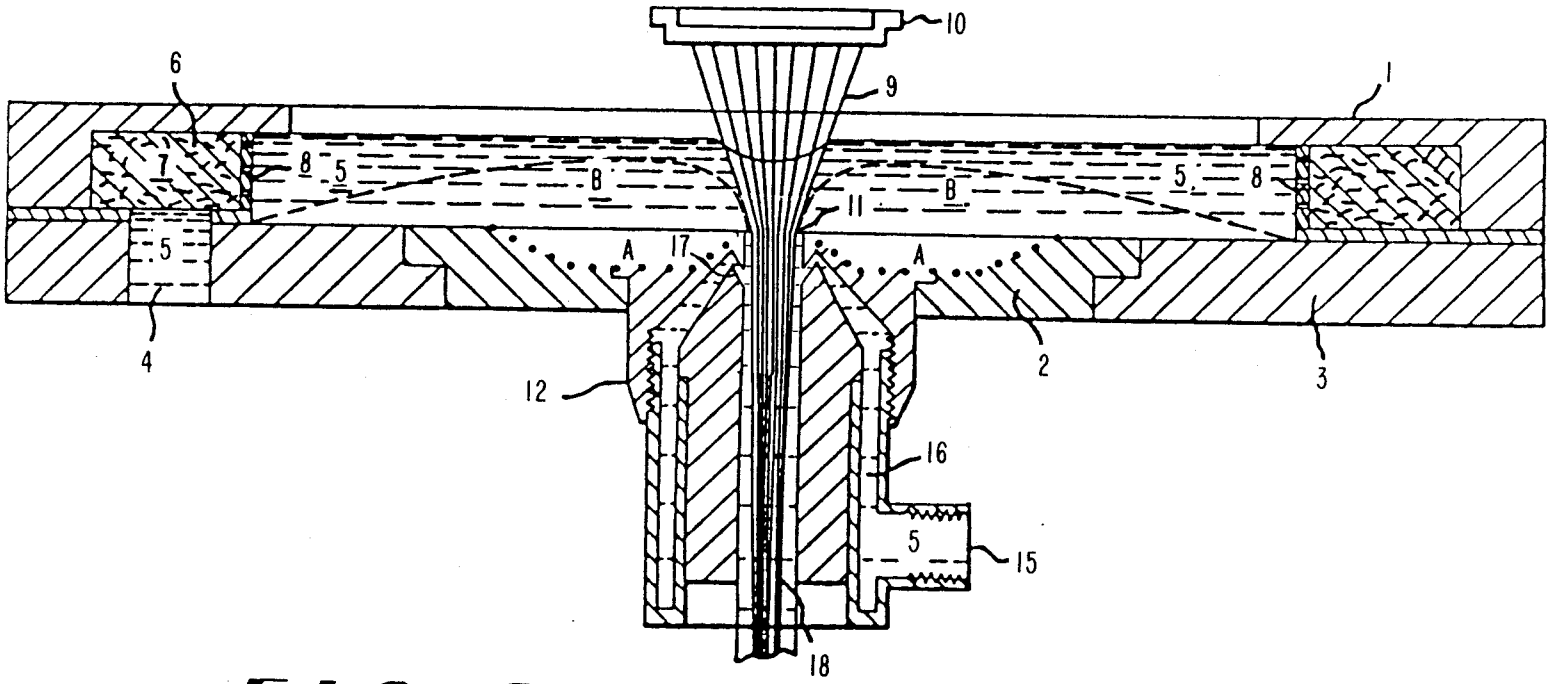
FIG. 1 is a cross-sectional schematic view of a coagulating bath apparatus suitable for practicing the invention.

The apparatus chosen for purposes of illustration is shown in FIG. 1 and includes a coagulating bath 1 which is a circular structure consisting of an insert disc 2 fitted into supporting structure 3. Supporting structure 3 includes an inlet 4 for introduction of coagulating liquid 5 under pressure into distribution ring 6 which contains a filler 7 suitable to enhance uniform delivery of coagulating liquid around the periphery of the coagulating bath 1. The filler 7 may be glass beads, a series of screens, a honeycomb structure, sintered metal plates, or other similar device. After passing through the filler 7, the coagulating liquid passes through perforated plate or screen 8 and flows uniformly without appreciable turbulence or back mixing horizontally toward the center of bath 1 where the coagulating liquid 5 contacts filaments 9 extruded from spinneret 10 whereby both coagulating liquid 5 and filaments 9 pass together through orifice 11 in a downward direction. Insert disc 2 may include circular jet device 12. The entrance of the jet device coincides with opening 11. Coagulating liquid 5 is introduced through opening 15 through passageway 16 to jet opening 17 whereby the coagulating liquid 5 passes along with filaments 9 and other coagulation liquid 5 in a downward direction through exit 18. Fibers so produced may be washed and/or neutralized and dried. The bath may have a depressed area A around orifice 11 or the bottom of the bath may be flat as when area A is filled in. In a preferred embodiment, the bath may have a contoured bottom as shown by raised area B over filled-in area A.

The coagulating liquid is usually aqueous, either 100% water or solutions of inorganic salts or of the acid used in the spin dope. The jetted liquid is usually the same as the coagulating liquid, but not necessarily. It may, in fact, be a non-coagulating liquid while maintaining ability to form staple fibers as taught herein.

When this structure is operated as exemplified below, fiber breaks occur below the face of the spinneret. The average staple-length is affected by numerous factors including size of the spin capillary and solution concentration. Of overriding importance, however, are distance from the spinneret to the point of accelerating force by the jet and the amount by which the jet-speed exceeds that required to cause fiber breakage.

Figure 2:
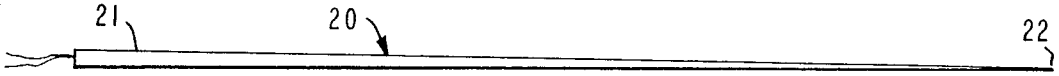
FIG. 2 is a schematic illustration of a staple fiber of this invention.

As shown in FIG. 2, the leading end 21 of each staple fiber 20 tapers toward the other end 22. The leading end is enlarged due to relaxation of the polymer solution immediately after each break occurs and before attenuation is again great enough to prevent relaxation. Very high molecular orientation occurs in the spin capillary. Each break results in temporary reduction of orientation, i.e., polymer orientation with respect to its micro-domains remains, but the micro-domains become disoriented by relaxation. Subsequent attenuation restores the original orientation and can even improve it.

The portion of each fiber which becomes enlarged by relaxation is normally a significant fraction of the total mass. As shown in the examples, this large amount of less oriented material does not adversely affect performance properties. Moreover, X-ray diffraction measurement of ACS (Apparent Crystallite Size) on the entire fibers, as described in the aforesaid U.S. Pat. No. 3,869,429, yields values of 35 to 45 Angstroms which, being so high, confirms that very high crystallinity and orientation exist in enlarged portions of each fiber.

The coagulated staple must be washed to remove solvent and any salts formed. The staple still in the coagulating liquid may be refined directly in a series of steps which involves several redispersions in water. Or it can be washed and stored while still wet with water for subsequent redispersion. Or, finally, it can be washed, dried, and stored dry for subsequent fluffing and dispersion. It is preferred that, in at least one of the early washing steps, the wash liquid be a dilute solution in water of an alkaline neutralizer (e.g., NaOH).

While the emphasis hereinbefore has been on the production of pulp, it should be pointed out that the staple obtained according to this invention has other uses common to staple fibers generally, for example, conversion to spun yarn via the carding, blending, drawing, twisting, and other processes well known in the art.

TEST METHODS

Canadian Standard Freeness

This is a procedure for measuring the drainage rate of a suspension of 3 grams of fibrous material in 1.0 L of water. Measurement and apparatus are according to TAPPI Standard T227 m-58. Results are reported as volume (mL) of water drained under standard conditions. The measured value is affected by the fineness and flexibility of the fibers and by their degree of fibrillation.

Clark Classification

This test measures the distribution of particle sizes in a supply of fibrous material, e.g., pulp as described hereinbefore. It is as detailed in TAPPI Standard T233 os-75 employing a Clark-type classifier. Basically it measures the weight percentage of fibrous stock retained on each of four progressively finer screens through which it is passed. The percentage passing through all four screens is obtained by difference, i.e., by subtracting from 100 the sum of the percent retentions on the screens. In the examples, the screen sizes employed were 14, 30, 50, and 100 mesh (U.S. Standard) with openings in mm of 1.41, 0.595, 0.297, and 0.149, respectively.

ASTM D-1708 Microtensile Test

The resin used for this test was Surlyn® 1605 ionomer resin (Surlyn® is a registered trademark of E. I. du Pont de Nemours). It is characterized by:

Specific gravity (ASTM D-792): 0.95
Flexural Modulus (ASTM D-790): 51 kpsi (350 MPa)
Melting Point (by DTA): 83° C.
Haze (ASTM D-1003A; 0.64 cm thick): 5%

Its flexural modulus is quite high, and it is so transparent that uniformity of fibrous dispersions in it can readily by assessed visually.

The above resin was added to a roll mill heated to 150° C. and milled until molten. Then, a sample of pulp was added over about 5 min by sprinkling it across the squeeze rolls while milling continued. About 15 to 20 min more of milling produced a visually uniform dispersion. For each 100 g of resin, 11 g of pulp was added. The uniform dispersion was sheeted by passage through the nip of two 6 inch (15.2 cm) diameter rolls. It was nominally 0.062 in (1.6 mm) thick.

Plaques for microtensile testing were prepared by placing two 4×4 inch (10.2×10.2 cm) portions into a 6×6×0.040 inch (15.2×15.2×0.10 cm) sheet mold, covering each surface first with a fluorocarbon release sheet and then with a rigid plate, and placing the assembly in a press preheated to 190° C. After about 2 min, pressure was raised to 10,000 lbs ($4.45\times10^4$ N) and released. This cycle was repeated 3 or 4 times before raising the pressure to 25,000 lb ($1.11\times10^5$ N) and holding it 2 min. The heaters were turned off and the press allowed to cool to room temperature. Then the pressure was released and the molded plaque removed.

Thereafter testing was exactly according to ASTM D-1708 using a stretch of 0.2 in/min (0.51 cm/min). Tensile strength at break and elongation at break are reported in the Table II.

ASTM D790-81 Flex Bar Test

Samples for this test were made as described under ASTM D-1708, above, except the mold used generated simultaneously four bars of dimensions 6×0.5×0.125 inch (15.24×1.27×0.3175 cm). Method I of ASTM D790-81 was used. Maximum Fiber Stress at failure of each bar was computed and reported as Flex modulus in the Table II.

Brake Bar Flex Strength

This test was also according to ASTM D-790-81, Method 1. The brake mix employed was composed of:

200-mesh Dolomite (basically $CaCO_3$): 1000 g

Barium sulfate 300 g

Cardolite 126 (cashew nut modified phenolic resin): 300 g

Cardolite 104-40 CFP (hardened cashew nut resin particles): 300 g

Selected pulp of PPD-T fibers: 100 g The pulp sample was fluffed for 5 to 10 min in a high-speed mixer. Remaining materials were added with mixing in the same mixer for 3 to 5 min or until a visibly uniform dispersion resulted. The mixture was molded into 3×6×0.25 inch (7.6×15.2×0.635 cm) plaques. Some of these were subsequently cut into 1×6×0.25 inch (2.5×15.2×0.635 cm) bars for testing. Three bars were tested as cut in a 70° F. (21.1° C.) atmosphere. Three other bars were conditioned first in an oven at 350° F. (177° C.) for 3 to 16 hours and then tested in a hot-box at 350° F. (177° C.). Each bar was centered on two supports spaced 4.0 in (10.2 cm) apart and pushed downwardly at its midpoint by a blunt pressure-foot moving 0.5 in/min (1.27 cm/min). None of these bars failed catastrophically. Instead, the maximum stress just before a sharp discontinuity in the stress-strain curve was used to compute Brake Bar Flex Strength. Results are in Table II.

SAE J661a Chase Friction Test

The procedure and equipment used were exactly as described in SAE J661a (last editorial change September 1971). The 1×1×0.25 inch (2.5×2.5×0.635 cm) test samples (2) were cut from the plaques as described above under "Brake Bar Flex Strength". For clarity, the "constant load" version of the test was employed. Results are in Table II.

In the following examples, pulps prepared according to this invention are compared to a Commercial Kevlar® (RTM) Aramid Pulp, that is, one prepared from continuous-filament yarns of PPD-T by first cutting the yarn to staple lengths and then wet-refining to pulp.

EXAMPLE 1

This example illustrates the production of staple fibers of PPD-T directly on spinning which fibers, after washing and neutralization, can be refined to pulp without the necessity for any fiber-cutting operation.

A 19.5% by weight solution of PPD-T (ninh—5.4 in 100.1% by weight sulfuric acid was prepared by mixing with external cooling so that the temperature of the solution did not exceed 75°–80° C. The solution at 75° C. was extruded at a rate of approximately 585 gm/min or less through a spinneret having 1000 holes of 0.0025 in (0.064 mm) diameter, passed through a 3 in (7.6 cm) long air gap and then into a shallow pool of water as the coagulating liquid and through an exit tube. The shallow pool of water was maintained with a water supply of about 0.5 gal/min. Jets of water were injected at a velocity approximately 1360 ypm (1244 mpm) at an angle of about 30° to the direction of the yarn spin-line just below the entrance to the exit tube so that flow of the liquid was so fast that the freshly formed filaments broke into staple lengths of 1 to 3 in (2.5 to 7.6 cm). Except that the jet flow was increased to produce discontinuous fibers, this process was substantially as described in U.S. Pat. No. 4,340,559 in its Example VIII using Tray G.

Under these conditions, the axial velocity, i.e., the vertically downward component of the water jet was approximately 1178 ypm (1077 mpm) while the solution jetting velocity from the spinneret holes was approximately 126 ypm (115 mpm). Thus, the velocity ratio of water jet to filament jetting velocity was approximately 9, whereas, the normal spin stretch ratio of windup velocity/filament jetting velocity for a 1.5 dpf fiber from a 2.5 mil spinneret hole is only about 6.0. The freshly extruded filaments were therefore hydrodynamically attenuated beyond the spin stretch limit and broken intermittently into staple fibers.

Each staple fiber was tapered continuously along its length. The wet fibers were collected, washed and neutralized. The never-dried fibers were subsequently slurried in water and hydro-refined in a wet-disc refiner. The resultant pulp was collected and dried.

The pulp obtained was characterized and compared with commercially available Kevlar® pulp as shown in Table I.

The large ends of the fibers fibrillated relatively little, accounting for the larger percentage of particles retained by the 14-mesh screen. Most of the fibers were, however, highly fibrillated with trunk lengths in the 2 to 5 mm range. The tails of these fibers were very small with a diameter in the 3–7 μm range. The fine fiber tails did not refine to form the fine particles in the pulp. In fact, the pulp of this invention contained fewer fine particles passing through a 100-mesh screen than did the commercially available pulp. The fine particles contribute as significantly to the strength and modulus of a reinforced composite as larger, more fibrillated particles.

The commercially available pulp and the pulp of this example were used in several standard tests with the results shown in Table II. These characterization reveal that the pulp of this example, relative to commercially available pulp, gave largely equivalent reinforcement performance. In the case of Surlyn® reinforcement, the pulp of this invention gave greater tensile strength and flex modulus than the commercially available pulp. These improvements can be attributed to the high strength and high modulus of the highly oriented fiber tails obtainable from the process of this invention. It can also be partly attributed to the large interfacial surface area of these fine fiber tails which enhances the fiber/-matrix adhesion.

EXAMPLE 2

This example illustrates the production of staple fibers of PPD-T directly on spinning under different process conditions from those of Example 1. The staple fibers thus obtained were subsequently refined to a pulp.

The process of Example 1 was repeated except that the solution was extruded at a rate of approximately 768 gm/min. The air gap was about 2 in (5.08 cm) long, the shallow pool of water as coagulating liquid was supplied with a flow of 1.0 gal/min and the jet (with water as coagulating liquid) was operated at 3.0 gal/min. Under these conditions, the velocity of the water jet was about 2040 ypm (1864 mpm); the axial velocity component of the water jet was approximately 1767 ypm (1616 mpm), and the solution jetting velocity from the spinneret holes was approximately 168 ypm (153.6 mpm). The ratio of water jet velocity to solution jetting velocity was about 10.5, which caused the freshly extruded filaments to attenuate beyond the spin stretch limit and be broken intermittently to form staple fibers of 1 to 3 in (2.5 to 7.5 cm). The resulting staple fibers were washed, neutralized and dried, and then hydrorefined to form a pulp.

The pulp obtained was characterized and compared with commercially available Kevlar ® pulp as shown in Table I. The changes in the operating conditions resulted in a pulp with different particle size distribution from that of Example 1. The weight fraction of large particles on 14 mesh screen decreased and that of small particles through 100 mesh screen increased, indicating an overall reduction of particle size.

Table II compares the test results of this pulp and commercially available Kevlar ® pulp in reinforcement matrix. The pulp of this example performed essentially the same as the commercial pulp within experimental accuracy.

TABLE I

| | Commercial Kevlar ® Aramid Pulp | Example 1 | Example 2 |
|---|---|---|---|
| Canadian Standard Freeness | 340 | 373 | 375 |
| Clark Classification (wgt. %) | | | |
| 14-mesh | 1.0 | 4.2 | 2.83 |
| 30-mesh | 14.5 | 22.0 | 19.03 |
| 50-mesh | 25.9 | 31.2 | 32.59 |
| 100-mesh | 18.3 | 17.2 | 13.36 |
| through 100-mesh | 40.3 | 25.4 | 32.19 |

TABLE II

| | Commercial Kevlar ® Aramid Pulp | Example 1 | Example 2 |
|---|---|---|---|
| Surlyn Reinforcement | | | |
| ASTM D-1708 Microtensile | | | |
| Tensile Strength | | | |
| (psi) | 1833–2980 | 3163 | 1556 |
| (MPa) | (12.64–20.54) | (21.80) | |
| Elongation (%) | 25.1–37.6 | 23.9 | 22.3 |
| ASTM D-795 Flex Bar | | | |
| Flex Modulus | | | |
| (kpsi) | 37.5–67.3 | 78.7 | 65.9 |
| (MPa) | (258–464) | (543) | |
| Brake Bar Flex Strength | | | |
| −70° F. (kpsi) | 5.8–5.9 | 5.57 | 6.20 |
| (−56.7° C.) (MPa) | (40.0–40.7) | (38.4) | |
| −350° F. (kpsi) | 2.46–2.75 | 2.66 | 2.62 |
| (−212.2° C.) (MPa) | (17.0–19.0) | (18.3) | |
| SAE J661a Chase Friction | | | |
| Coefficient of Friction | | | |
| Normal | 0.295–0.350 | 0.315 | 0.322 |
| Hot | 0.294–0.332 | 0.308 | 0.298 |
| Class | E/E | E/E | E/E |
| % Mass Wear | | | |
| Normal | 2.68–6.70 | 2.51 | 2.53 |
| Accelerated | 2.48–5.11 | 4.16 | 5.01 |

I claim:

1. In a process for preparing high strength, high modulus aromatic polyamide fibrous material comprising extruding an optically anisotropic acid solution of an aromatic polyamide through at least one spinning capillary at a first velocity to form a filament, then passing the extruded filament through a layer of non-coagulating fluid into a coagulating bath, and discharging the coagulated filament through an exit tube together with overflowing coagulating liquid and a liquid jetted symmetrically about the filament in and near the entrance to the exit tube in a generally downward direction to provide a vertically downward component of jet velocity, the improvement comprising establishing a ratio of said vertically downward component to said first velocity sufficient to break the uncoagulated extruded filament intermittently into staple fibers as it leaves the capillary.

2. The process of claim 1 wherein said ratio is at least 9.

3. The process of claim 2 including the additional step of abrading said stable fibers to convert them into pulp.

* * * * *